US006917340B2

(12) United States Patent
Lindenmeier

(10) Patent No.: US 6,917,340 B2
(45) Date of Patent: Jul. 12, 2005

(54) COMBINATION ANTENNA ARRANGEMENT FOR SEVERAL WIRELESS COMMUNICATION SERVICES FOR VEHICLES

(75) Inventor: Heinz Lindenmeier, Planegg (DE)

(73) Assignee: FUBA Automative GmbH & Co. KG, Bad Salzdetfurth (DE)

( * ) Notice: Subject to any disclaimer, the term of this patent is extended or adjusted under 35 U.S.C. 154(b) by 0 days.

(21) Appl. No.: 10/770,652

(22) Filed: Feb. 3, 2004

(65) Prior Publication Data

US 2004/0183737 A1 Sep. 23, 2004

(30) Foreign Application Priority Data

Feb. 6, 2003 (DE) ..... 103 04 911

(51) Int. Cl.[7] ..... H01Q 1/32
(52) U.S. Cl. ..... 343/725; 343/713; 343/749
(58) Field of Search ..... 343/713, 725, 343/749, 750, 751, 752, 853

(56) References Cited

U.S. PATENT DOCUMENTS 4,443,803 A * 4/1984 DeSantis et al. ..... 343/749
5,610,620 A * 3/1997 Stites et al. ..... 343/725
5,973,648 A 10/1999 Lindenmeier et al. ..... 343/713
6,078,295 A * 6/2000 Rawle ..... 343/730
6,140,969 A * 10/2000 Lindenmeier et al. ..... 343/700 MS
6,229,495 B1 * 5/2001 Lopez et al. ..... 343/791
6,653,982 B2 11/2003 Lindenmeier et al. ..... 343/741

* cited by examiner

*Primary Examiner*—Tho Phan
(74) *Attorney, Agent, or Firm*—Collard & Roe, PC

(57) ABSTRACT

A combination antenna arrangement is provided for at least two wireless communication services, wherein a closely tolerated directional diagram is configured for the first wireless service, in a frequency range assigned to it. Antenna conductor parts are provided only for the function of the additional wireless communication services, and are radiation-coupled with the antenna assigned to the first wireless communication service. The conductor parts are divided into segments forming interruption points designed to be smaller than ⅜ λ for this first wireless service. The interruption points are bridged by low-loss, frequency-dependent reactance circuits (8), in order for the combination antenna arrangement to function. These circuits possess a sufficiently high impedance in the frequency range of the first service and an impedance that is predetermined for proper functioning for the frequency range of the frequency range of the additional communication services.

16 Claims, 13 Drawing Sheets

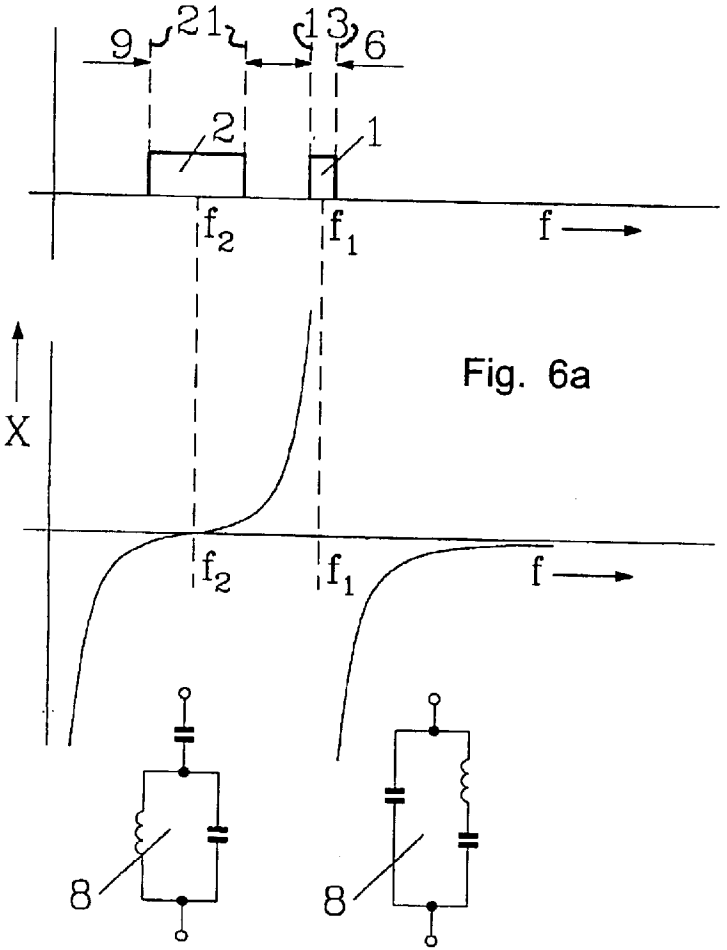
Fig. 6a
Fig. 6a'
Fig. 6a"
f
X
$f_1$
$f_2$
1
2
6
9
13
21
8
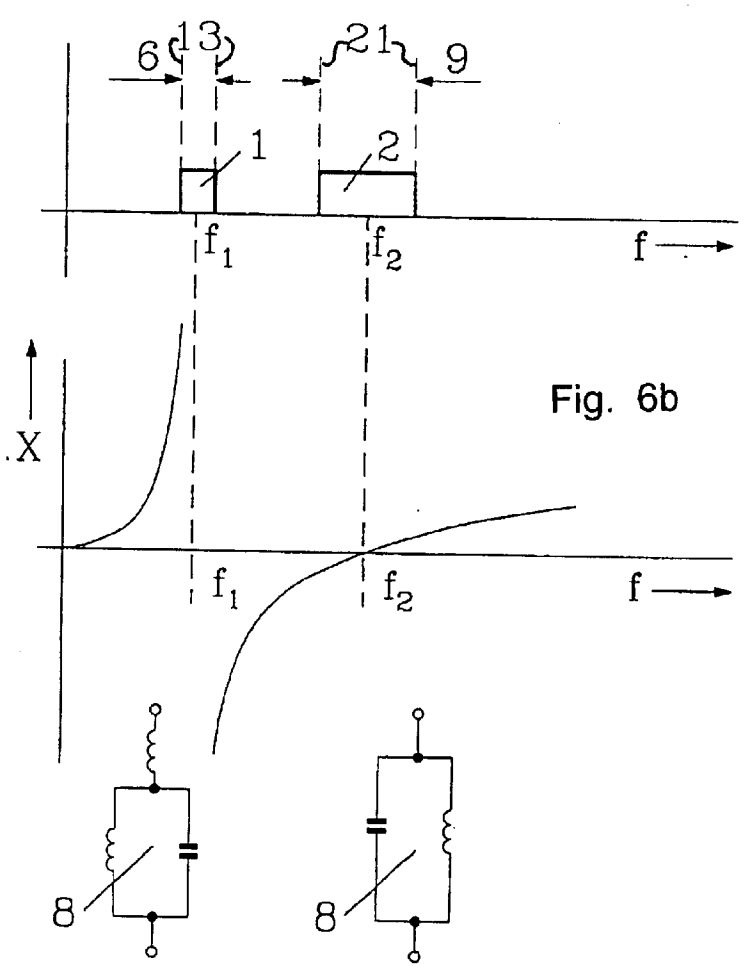
Fig. 6b
Fig. 6b'
Fig. 6b"
f
X
$f_1$
$f_2$
1
2
6
9
13
21
8

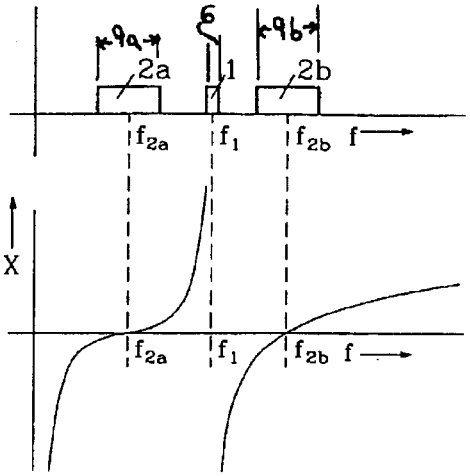
Fig. 6c
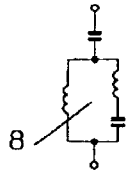
Fig. 6c'
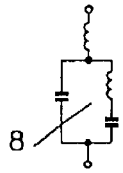
Fig. 6c"
Fig. 6c
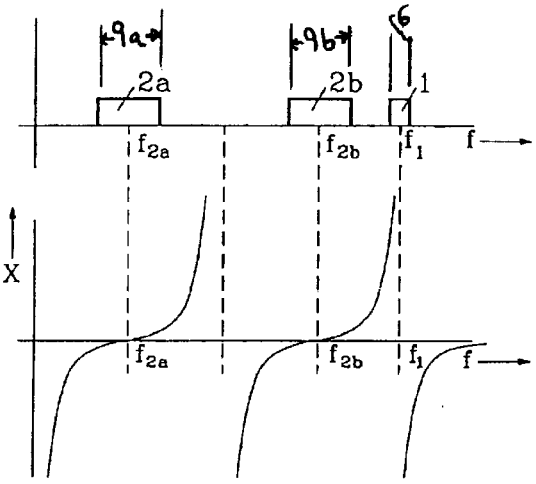
Fig. 6d
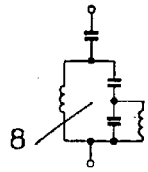
Fig. 6d'
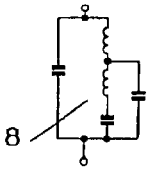
Fig. 6d"
Fig. 6d
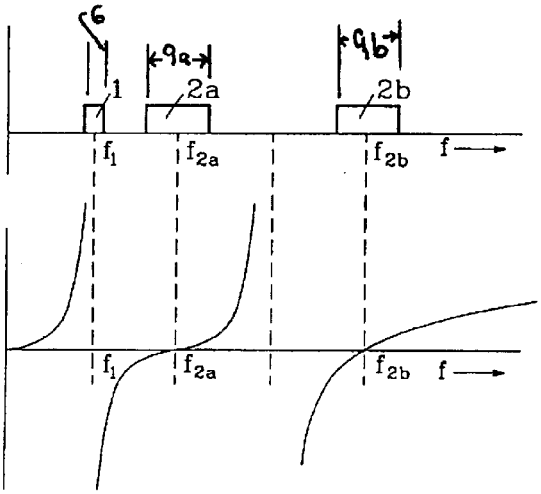
Fig. 6e
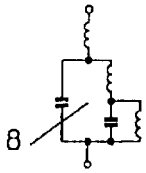
Fig. 6e'
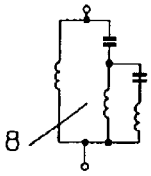
Fig. 6e"

COMBINATION ANTENNA ARRANGEMENT FOR SEVERAL WIRELESS COMMUNICATION SERVICES FOR VEHICLES

BACKGROUND OF THE INVENTION

Field of the Invention

This invention relates to a combination antenna arrangement for at least two wireless communication services for vehicles, by which a closely tolerated directional diagram is configured for the first wireless communication service, in a frequency range assigned to it, at A predetermined antenna connection point.

Because of the small construction space available, there is a significant demand for compactness smallness and, in particular, for minimizing the footprint of the antenna, in the case of vehicle antennas. U.S. Pat. No. 5,973,648 describes a combined antenna design for which the telephone services of the GSM-900 system, and the GSM-1800 system (cell phone systems of the D-network and the E-network), as well as the AMPS system, which is used in the United States, are mentioned as examples of use. In addition to these telephone services, a satellite wireless communication service is supposed to be made possible, such as the Global Positioning System (GPS) or a bi-directional satellite wireless communication service with low-flying satellites (Leos), which is in the planning stage.

Particularly for satellite wireless communication services as the first wireless communication service 1, the combination of satellite antennas and antennas for other wireless communication services 2 in a confined space is problematical, because of the radiation coupling between the antennas, and the related distortion of the directional diagram of the satellite antenna. This is particularly due to the limited link budget, which can result in a breakdown of the wireless communication connection in case of a drastic distortion of the directional diagram. For example, in the case of satellite antennas according to the standard of SDARS satellite wireless communication, an antenna gain of a constant 2 dBi or 3 dBi for circular polarization is a strict requirement in the elevation angle between 25 or 30 degrees and 60 or 90 degrees, for example, depending on the operator. This demand exists for an antenna structured in the center of a level conductive base plate. This demand can only be met if the deviation from the ideal radiation characteristic does not amount to more than approximately 0.5 dB at any spatial angle.

Therefore the directional diagram has extremely close tolerances, particularly in view of the scale that is known for antennas on vehicles. U.S. Pat. No. 6,653,982 B2 indicates the construction of an antenna, for example, that allows adherence to the closely tolerated directional diagram. Using antennas having this construction, it is possible, in general, to provide the antenna gain in the region of the zenith angle without problems. In the case this antenna, the reception of terrestrially broadcast signals according to the SDARS standard is combined with a monopole antenna, thereby resulting in a small construction of the combined antenna for the first wireless communication service 1, which is advantageous for use in vehicles. A close tolerance requirement must therefore be maintained, to a great extent, for the structure on a vehicle.

SUMMARY OF THE INVENTION

It is therefore an object of the present invention to provide an antenna affixed in the close proximity of a first antenna for the first wireless communication service having a closely permissible antenna directional diagram, or combined with this antenna, for additional wireless communication services, which avoid the disadvantages of distortion of the antenna directional diagram of the antenna for the first wireless communication service.

The great advantage of antenna arrangements according to the invention consists in concentrating combination antennas for several wireless communication services for vehicles in an extremely small space, without having to accept impermissible diagram distortions for the first wireless communication service, while adhering to particularly stringent requirements with regard to a reference directional diagram.

According to the invention, a high-precision antenna for SDARS (first wireless communication service 1) can be combined with two combination antennas for AMPS and PCS cell phone (other wireless communication services 2), in a housing having the dimensions of about 12 by 5 cm (corresponding to only about 1 λ times 0.4 λ, with reference to the wavelength of the SDARS service), whereby the antennas for these additional functions have a distance of about 0.3 λ, with reference to the wavelength of the SDARS service, from the center of the SDARS antenna. Moreover, a patch antenna for GPS is also integrated into the housing. This distance of only 0.3 λ is possible in that only 5 cm was selected as the height of the telephone radiators, and these were divided twice, whereby the maximum distance between two interruption points only amounts to 2 cm, corresponding to 0.16 λ, with reference to the wavelength of the SDARS service.

BRIEF DESCRIPTION OF DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIGS. 6*a* and 6*a*' and 6*a*" show the required reactance progressions X(f) and design of circuits composed of dummy elements, wherein the first wireless communication service 1 lies above the additional wireless communications service 2 in terms of frequency;

FIGS. 6*b*, 6*b*' and 6*b*" show the required reactance progressions X(f) and design of circuits composed of dummy elements, for the case the first wireless communication service 1 lies below the additional wireless communications service 2 in terms of frequency;

FIGS. 6*c*, 6*c*' and 6*c*" show the required reactance progressions X(f) and design of circuits composed of dummy elements, for the case that the first wireless communication service 1 lies between two additional wireless communications services 2 in terms of frequency;

FIGS. 6*d*, 6*d*' and 6*d*" show the required reactance progressions X(f) and design of circuits composed of dummy elements, for the case that the first wireless communication service 1 lies above the two additional wireless communications services 2 in terms of frequency;

FIGS. 6*e*, 6*e*' and 6*e*" show the required reactance progressions X(f) and design of circuits composed of dummy elements, for the case that the first wireless communication service 1 lies below the two additional wireless communications services 2 in terms of frequency;

DETAILED DESCRIPTION OF THE PREFERRED EMBODIMENTS

Figure 1C:
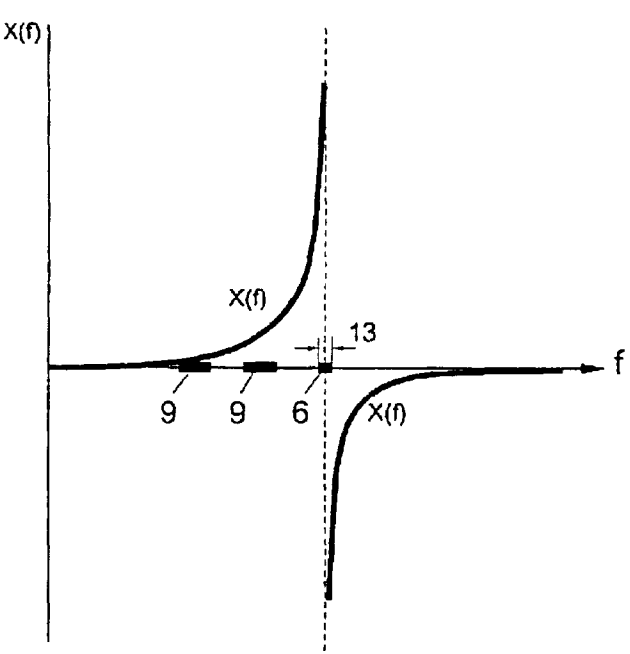
FIG. 1*c* shows a typical impedance and reactance diagram of the reactance circuit of FIG. 1*a* with respect to frequency.
Figure 1B:
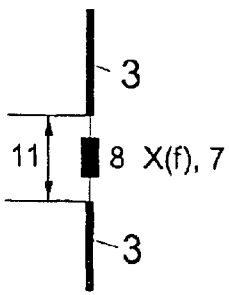
FIG. 1*b* shows a detail of the interruption point of the antenna arrangement of FIG. 1*a;*
Figure 1A:
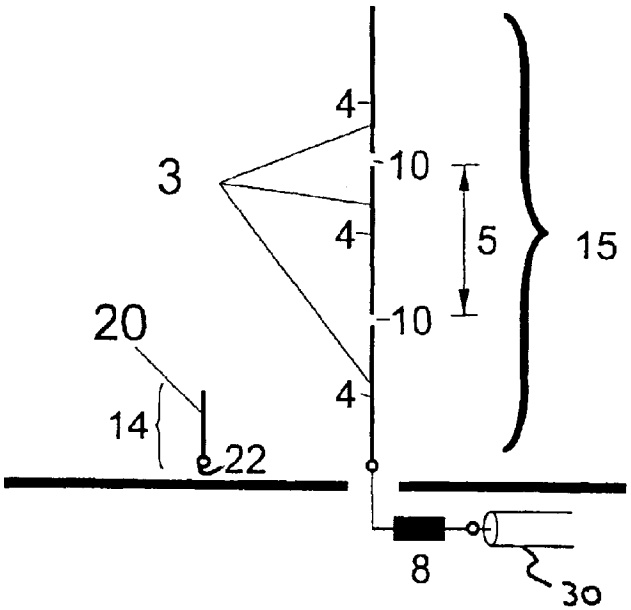
FIG. 1*a* shows a combination antenna arrangement having a first antenna for the first wireless communication service, and a second antenna that is radiation-coupled for an additional wireless communication service, according to the invention.

Referring to FIG. 1*a*, there is shown a first antenna 14 in the form of a λ/4 antenna 20, with an antenna connection point 22 for the first wireless communication service 1. The effects of its radiation coupling with an additional antenna 15 for an additional wireless communication service 2 on the directional diagram of the first wireless communication service 1, will be explained as a function of the division of additional antenna 15 into parts. In order to reduce the radiation coupling, segments 4, are formed by providing a series of interruption points 10 spaced apart by a segment length 5. A coax line 30 is coupled to antenna 15 through an inductance 8.

FIG. 1*b* is a detail circuit of the interruption point of the antenna arrangement of FIG. 1*a* with an inductance 8 coupled between antenna segments 3 in separation 11.

FIG. 1*c* shows a typical impedance and reactance diagram of the reactance circuit of FIG. 1*b* with respect to frequency f.

Figure 2A:
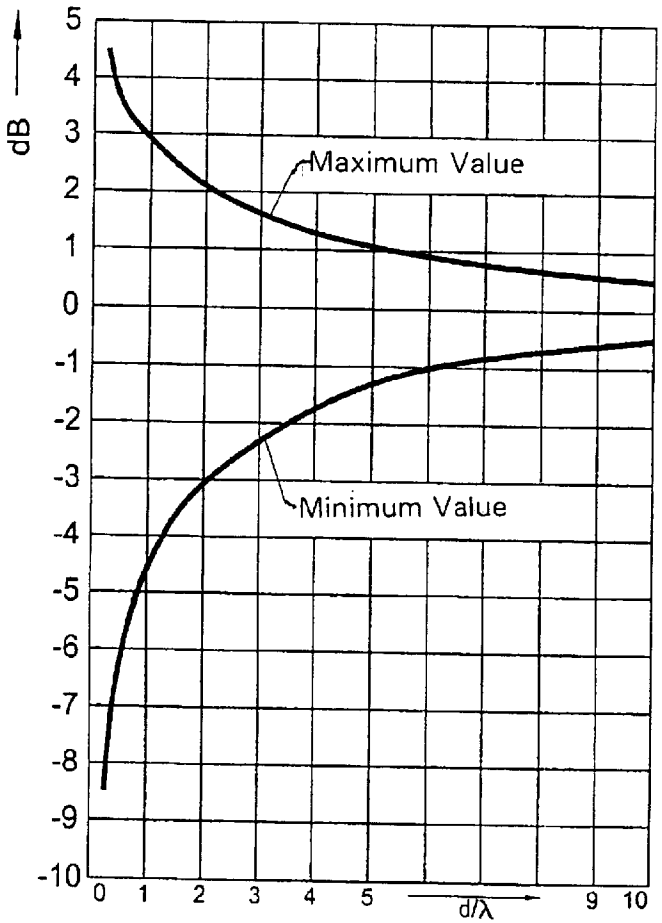
FIGS. 2*a* and 2*a*' show the effects of the radiation coupling on the horizontal diagram of the first wireless communication service 1, if the antenna for the additional wireless communication service consists of two antenna parts of λ/2 each, with reference to the wavelength of the first wireless communication service, and the distance d between the antennas is changed.
Figure 2A:
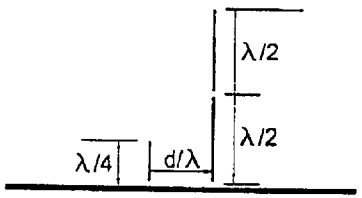

FIGS. 2*a* to 2*d*' show the diagram distortions of antenna 14, in dB, that result from the presence of additional antenna 15. In this connection, FIG. 2*a* shows the maximal influence of an antenna 15 having a total length of λ, which is divided into two segments 4 having a length of λ/2 as shown in FIG. 2*a*'. For use in a vehicle, for the case of an SDARS antenna, distances of $0.5<d/\lambda<3$ are of interest. The accompanying deviations between +3.5 dB and −6.5 dB for $d/\lambda=0.5$ dB, and +1.5 dB and −2.5 dB for $d/\lambda=3$, respectively, are completely unsuitable for use of a closely tolerated antenna for the first wireless communication service.

Figure 2B:
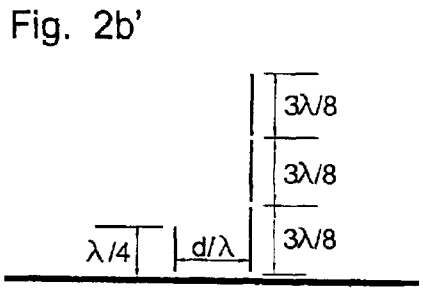
FIGS. 2*b* and 2*b*' are similar to that of FIGS. 2*a*, 2*a*' but with divisions of the antenna according to the invention, at intervals of 3λ/8, with reference to the wavelength of the first wireless communication service.
Figure 2C:
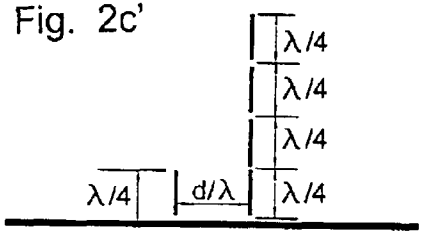
FIGS. 2*c* and 2*c*' are similar to that of FIGS. 2*a*, 2*a*' but with divisions of the antenna according to the invention, at intervals of λ/4, with reference to the wavelength of the first wireless communication service.
Figure 2D:
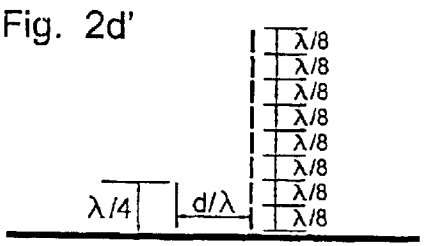
FIGS. 2*d* and 2*d*' are similar to that of FIGS. 2*a*, 2*a*' but with divisions of the antenna according to the invention, at intervals of λ/8, with reference to the wavelength of the first wireless communication service.
Figure 2B:
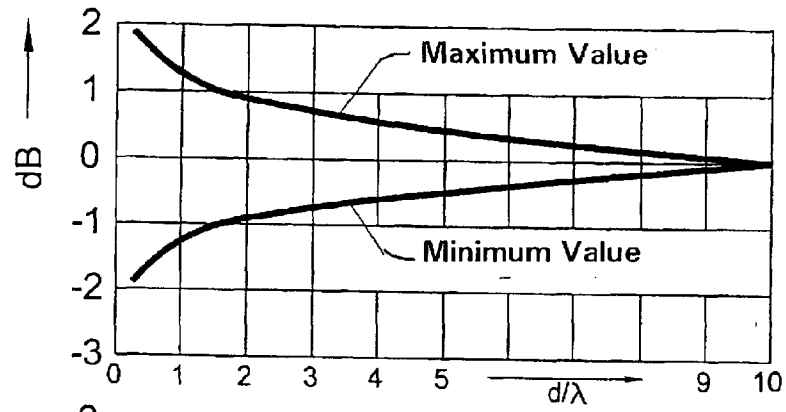
Figure 2C:
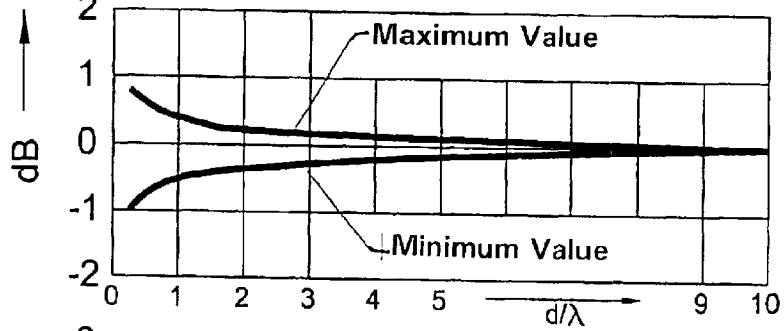
Figure 2D:
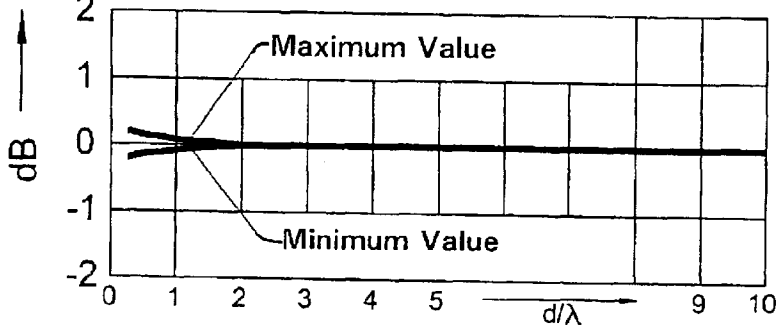

It is of great advantage of the present invention that the design permits a maximal segment length 5 of 3λ/8, as shown in FIG. 2*b*', for each division, thereby reducing the corresponding distortion as shown in FIG. 2*b* to the range between +/−1.5 dB ($d/\lambda=0.5$) and +/−0.8 dB ($d/\lambda=3$). With more divisions, i.e. with a segment length 5 that becomes shorter, the distortion of the directional diagram decreases significantly. This is evident from FIGS. 2*c* and 2*d*, where the corresponding distortion is reduced to the range between +/−0.5 dB or +/−0.2 dB, or to a maximum of +/−0.2 dB at a segment length of λ/8. The present invention therefore requires selecting segment length 5 to be sufficiently small and, where additional antenna 15 is used for the additional wireless communication services 2 to bridge interruption points 10, as shown in FIG. 1*b*, with reactance circuits 8, so that the impedance that is active between interruption points 10 is sufficiently great.

Figure 2F:
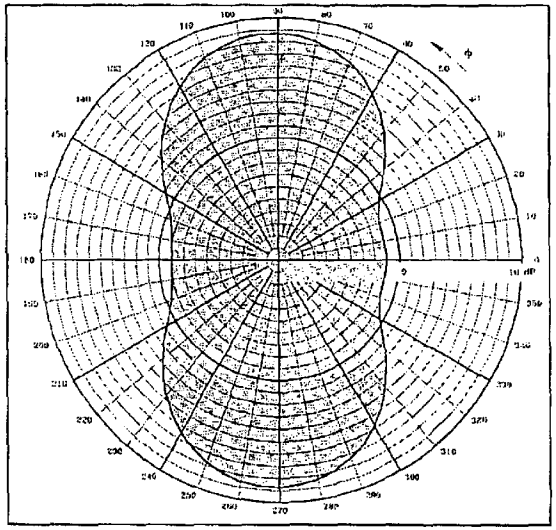
FIG. 2*f* shows a horizontal circular diagram of the antenna as in FIG. 2*e*, if, in accordance with FIG. 2*a*, conductor parts of λ/2 each, with reference to the wavelength of the first wireless communication service, are present.
Figure 2E:
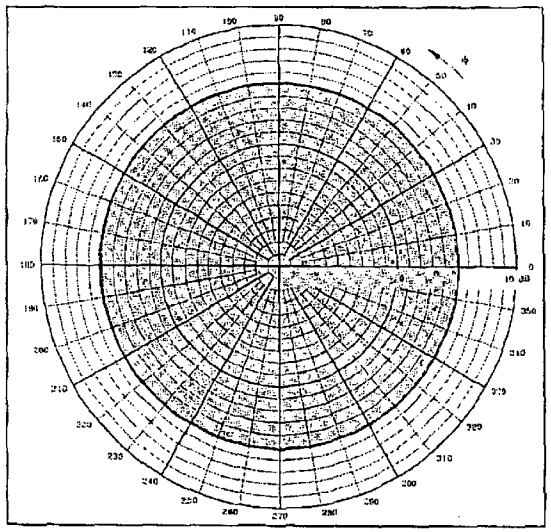
FIG. 2*e* shows a horizontal circular diagram of the antenna of the first wireless communication service 1, if no conductor parts that are radiation-coupled are present.

FIGS. 2*e, f*, and *g* show the typical effects on directional diagrams of antenna 14 for the first wireless communication service 1. In all three cases, the horizontal diagrams are shown for vertical polarization, which react with particular sensitivity, and the antennas are arranged on a conductive surface that extends infinitely. FIG. 2*e* shows the circular, angle-independent diagram of antenna 14 in the absence of conductor parts 3 of the additional wireless communication services. This diagram is therefore the reference diagram for the deviations that result in the presence of conductor parts 3 of the additional wireless communication services.

Figure 2G:
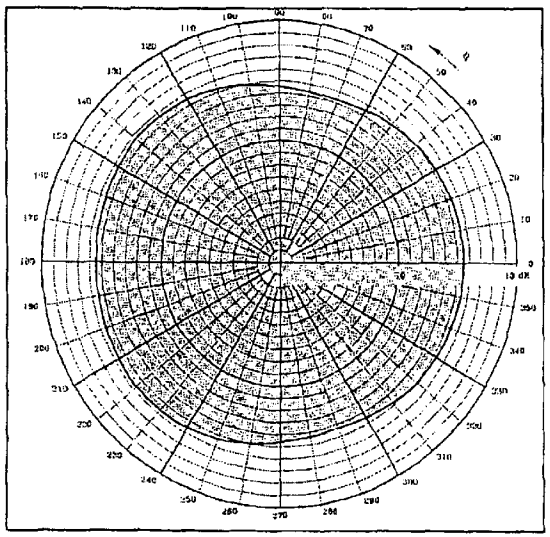
FIG. 2*g* shows a horizontal circular diagram of the antenna as in FIG. 2*e*, if, in accordance with FIG. 2*c*, conductor parts of λ/4 each, with reference to the wavelength of the first wireless communication service, are present.

FIG. 2*f* relates to a combination antenna arrangement according to FIG. 2*a*', in other words to an embodiment of additional antenna 15 that is not in accordance with the invention, for a distance $d/\lambda=0.5$. The diagram distortion is definitely impermissibly great. In contrast to this, the diagram according to FIG. 2*g* demonstrates only comparatively slight changes as compared with that of FIG. 2*e*. FIG. 2*g* relates to the antenna arrangement of FIG. 2*c*', and again applies for a distance $d/\lambda=0.5$. In accordance with the invention, the influences can be further reduced if either the distance $d/\lambda$ is increased, while keeping the division of conductor parts 3 the same, or if the additional antenna 15 is divided more frequently, as in FIGS. 2*d*, 2*d*' by reducing the maximal dimensions 5 of segments 4.

In the most general case, it is a requirement for the reactance circuits 8 that the frequency progression of the reactance circuits 8 is configured as in FIG. 1*c* and possesses a pole position in the frequency range 6 of the first wireless communication service 1, and is sufficiently great, in terms of amount, over the frequency bandwidth 13 of the range, and that the reactance X in the frequency ranges 9 of the additional wireless communication services 2 is sufficiently small. For the required values for reactance 8 within frequency range 6, it turns out that the impedance should not go below about 1 kΩ for conductor parts 3 of the additional wireless communication service that are divided into segments having a length of $\lambda/4$, for example, whereby the capacitative effects between the two adjacent segments must also be taken into consideration.

Figure 3A:
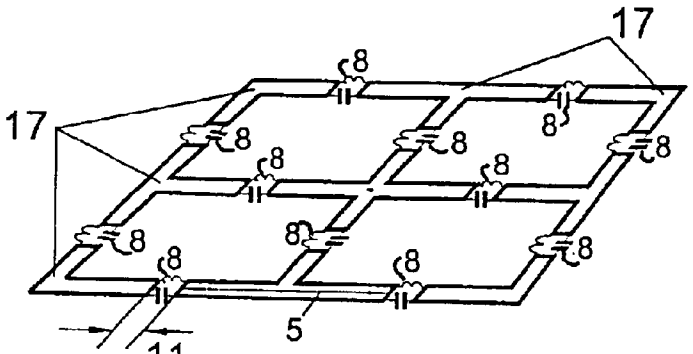
FIG. 3*a* shows an embodiment of linear conductor parts according to the invention, with interruption points and reactance circuits disposed between them, provided as parallel resonance circuits.
Figure 3B:
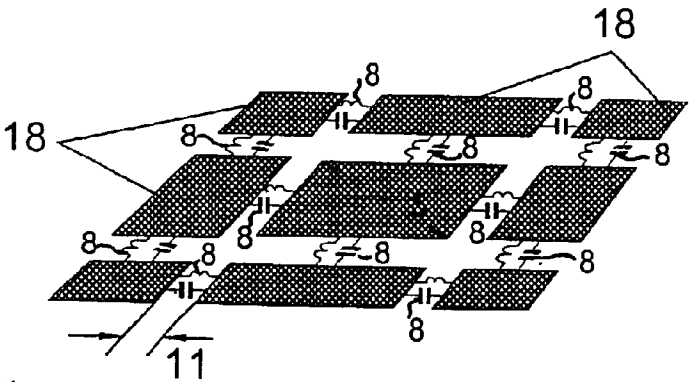
FIG. 3*b* shows an embodiment of flat conductor parts according to the invention, with interruption points and reactance circuits between them, provided as parallel resonance circuits.
Figure 3C:
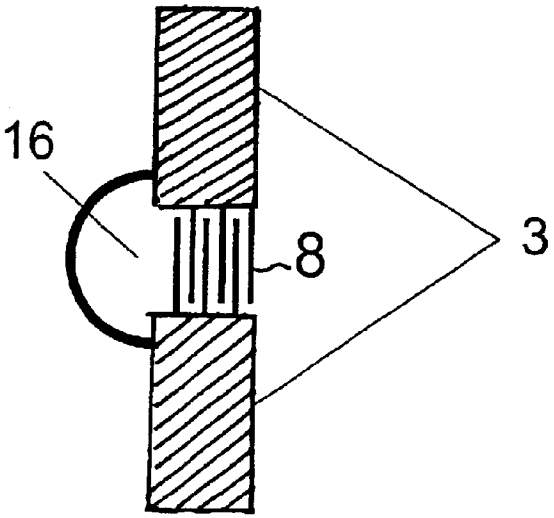
FIG. 3*c* shows a detail of the design of the parallel resonance circuits in printed-circuit technology, for cost-effective and precise production of the reactance circuits.

In FIG. 3*b*, the segments of additional antenna 15 according to the invention are configured in a flat manner, and their maximal dimension 5 must also be selected to be less than $3\lambda/8$. Here, the widths 11 of interruption points 10 must be selected to be small in comparison with maximal dimension 5, and reactance circuits 8 must be configured so that impedances 7 that are in effect between interruption points 10 essentially possess the frequency behavior of a parallel resonance circuit 16 in frequency range 6 of the first wireless communication service. The configuration of these flat segments can preferably be implemented, for example, in printed or stripline circuits, including the parallel resonance circuits 16 as shown in the structure of FIG. 3*c*. FIG. 3*c* therefore shows a particularly cost-effective, reliable printed circuit embodiment of a parallel resonance circuit 16 for a combination antenna arrangement according to the invention, which can be produced with only slight production variations. FIG. 3*a* shows an electrically equivalent circuit approximation to the total surface according to the circuit of FIG. 3*b*, by means of linear structures 17.

Figure 4:
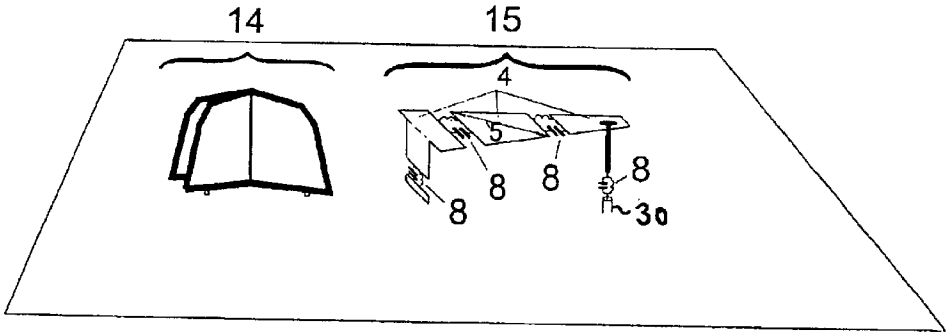
FIG. 4 shows an example of a combination antenna arrangement according to the invention, with a flat antenna for the additional wireless communication service.

FIG. 4 shows an additional antenna 15 for an additional wireless communication service 2 placed in the close proximity of a first antenna 14 for a first wireless communication service 1 having a closely tolerated antenna directional diagram. As an example, a first antenna 14 is shown in the drawing as an antenna as indicated in U.S. Pat. No. 6,653,982 B2. An antenna known as an inverted F is shown as an additional antenna 15. In order to adhere to the strict tolerance provisions of the directional diagram for first antenna 14, the flat elements of the additional antenna 15 are divided in accordance with the rules stated in connection with the antenna of FIG. 3*b*.

Figure 5:
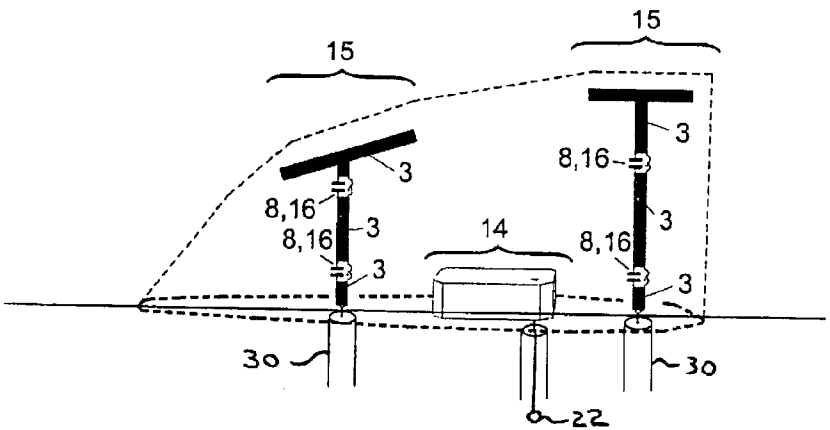
FIG. 5 shows an example of a combination antenna arrangement according to the invention, with two additional linear antennas having a monopole design.

FIG. 5 shows a first antenna 14 in combination with additional antennas 15 affixed in close proximity to the former, structured as linear antennas. Additional antennas 15 are provided for wireless communication services such as AMPS, GSM 900, PCS, GSM 1800 or UMTS. With a satellite radio antenna as a first antenna 14, the directional diagram of this antenna cannot be tolerated, due to the presence of additional antenna 15, without the proposed measures. In an advantageous embodiment of the present invention, parallel resonance circuits 16 are therefore introduced into additional antennas 15, which are structured as monopoles. In order to avoid resonance currents in the conductor parts of the additional antennas 15, the connections to them are also separated by means of parallel resonance circuits 16 affixed in the lower part of the radiators.

In a particularly advantageous embodiment of the present invention, reactance circuit 8 is configured, in each case, so that they possess a zero point at a frequency $f_2$ in the frequency range 9 of an additional wireless communication service 2, and a pole in the frequency range 6 of the first wireless communication service 1 as shown in FIGS. 6*a* and 6*b*. Thus, a sufficiently low-ohm impedance 7 exists over the frequency bandwidth 21 of an additional wireless communication service 2, and a sufficiently high-ohm impedance exists over the frequency bandwidth 13 of the first wireless communication service 1.

FIGS. 6*a*' and 6*a*" show two possible reactance circuits where the frequency range 6 of the first wireless communication service 1 is higher in frequency than frequency range 9 of the additional wireless communication service 2. FIGS. 6*b*' and 6*b*" show corresponding reactance circuits 8 for the case where the frequency range 9 is higher than the frequency range 6.

FIGS. 6*c*' and 6*c*" show types of reactance circuits 8 if additional wireless communication services 2 are present, whereby the frequency range 6 of the first wireless communication service lies between the two frequency ranges 9*a*, 9*b*, of the additional wireless communication services 2 in their frequencies $f_{2a}$, $f_{2b}$ as in FIG. 6*c*. FIGS. 6*d*', and 6*d*" show types of reactance circuits 8 if two frequency ranges 9*a*, 9*b* of the additional wireless communication services 2 exist, which as shown in FIG. 6*d*, are lower in their frequencies, $f_{2a}$, $f_{2b}$ or, as in FIG. 6*e*, higher in frequency than the frequency range 6 of the first wireless communication service 1, with corresponding reactance circuits 6*e*' and 6*e*".

Figure 7B:
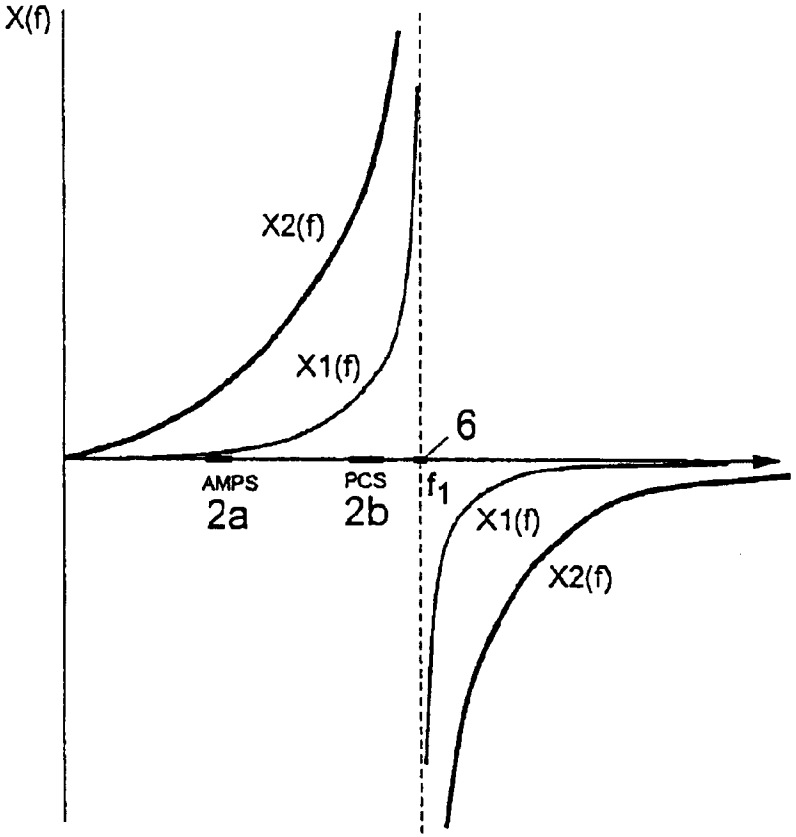
FIG. 7*b* shows a progression chart of the impedances and reactances X1 (f) and X2 (f)
Figure 7A:
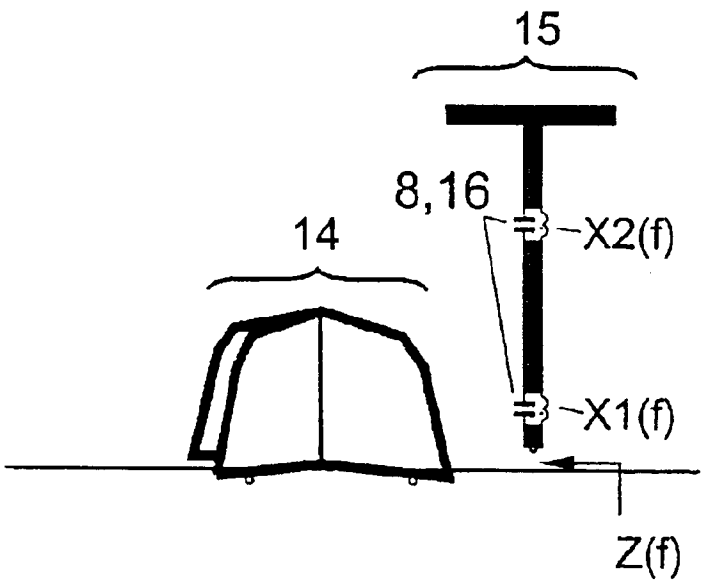
FIG. 7*a* shows an example of a combination antenna arrangement according to the invention with an additional linear antenna having a monopole design.
Figure 7C:
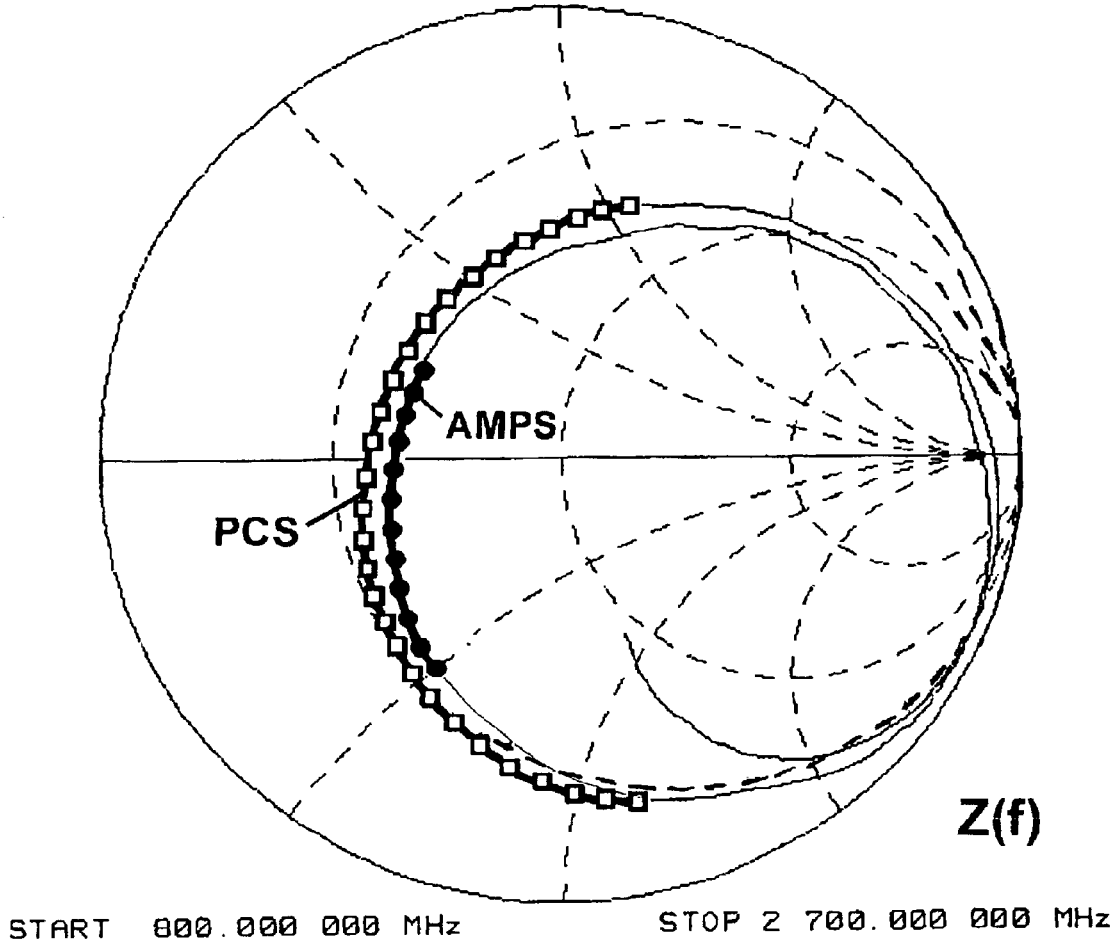
FIG. 7*c* shows the resulting typical circular diagram of the base or foot-point impedance Z(f) of the antenna.

In FIG. 7*a*, a linear antenna 15 is shown for the cell phone services AMPS and PCS, and placed in close proximity of an antenna 14 according to the SDARS standard. The interruption points 10 of additional antenna 15 are each configured with a parallel resonance circuit 16, the reactance progressions of which are shown as a function of the frequency in FIG. 7*b*. At the frequency $f_1$ in the frequency range 6 of the first wireless communication service 1, the impedance X1 (f) forms a pole at the bottom end of the monopole, and is at sufficiently high impedance over the frequency bandwidth 13 of the first wireless communication service 1, in order to practically not impair the directional diagram of first antenna 14, and is selected to be sufficiently low in the indicated frequency ranges of PCS and AMPS. The reactance X2 (f) at the interruption points 10 in the upper third of additional antenna 15 is configured in similar manner, and because of its high impedance, it causes the upper part in the frequency range PCS to be shut off at full effectiveness in the frequency range of AMPS. The impedance progression Z(f) shown in the chart of FIG. 7*c*, in the foot point of additional antenna 15, shows the adaptation that has been achieved in the two cell phone services.

Figure 8A:
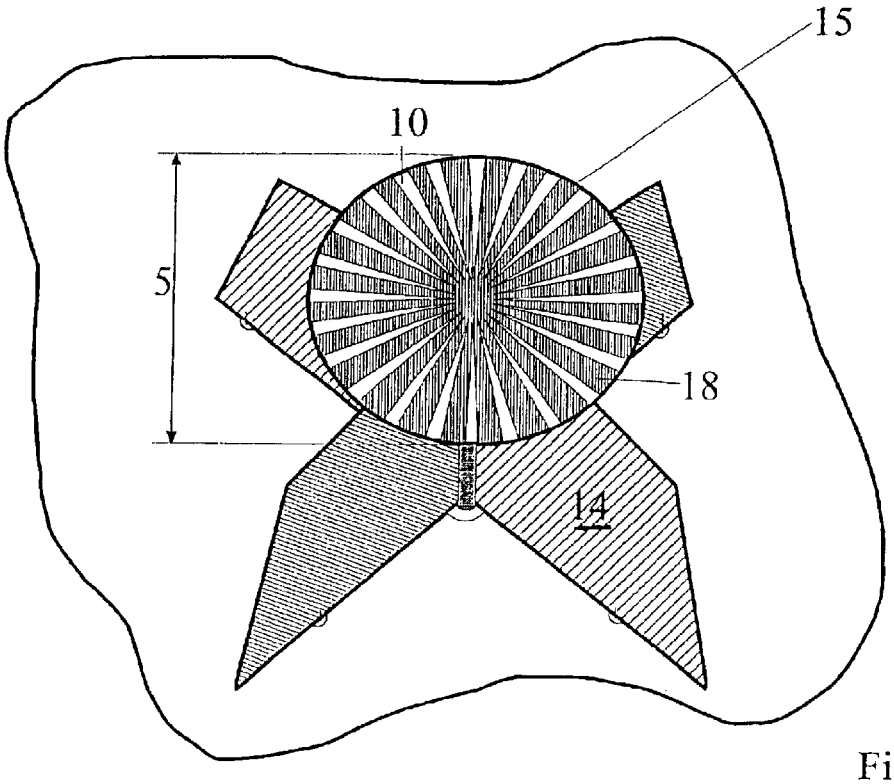
FIG. 8*a* shows a combination antenna arrangement according to the invention with an SDARS antenna having rotational symmetry, and a combined linear monopole along the line of symmetry, as well as a roof capacitor that is radially interrupted.
Figure 8B:
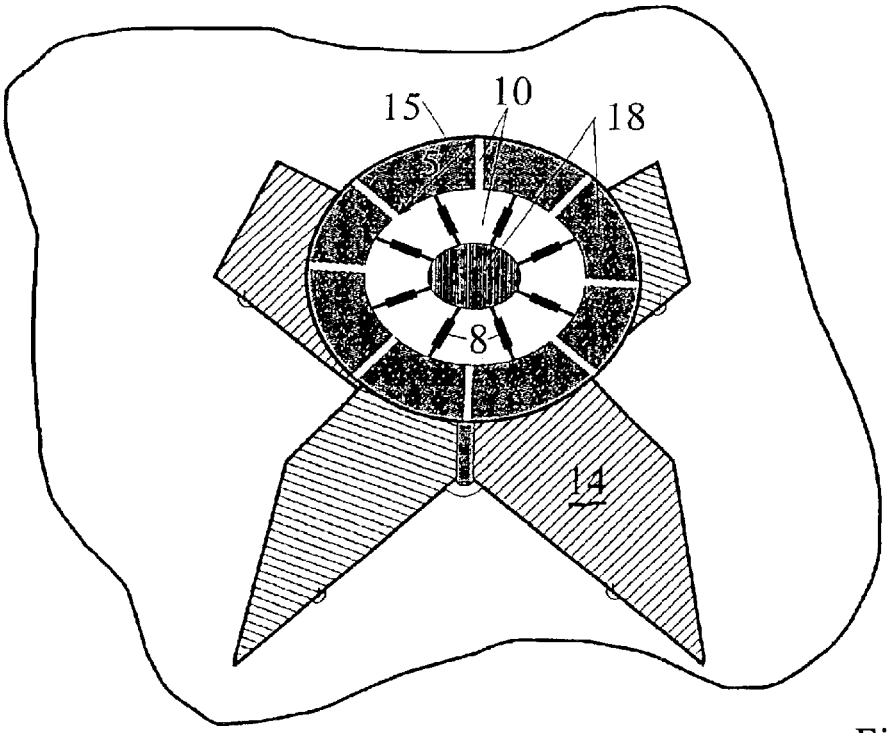
FIG. 8*b* shows a combination antenna arrangement according to the invention with an SDARS antenna having rotational symmetry, and a combined linear monopole along the line of symmetry, as well as a roof capacitor having one radial interruption point.
Figure 8D:
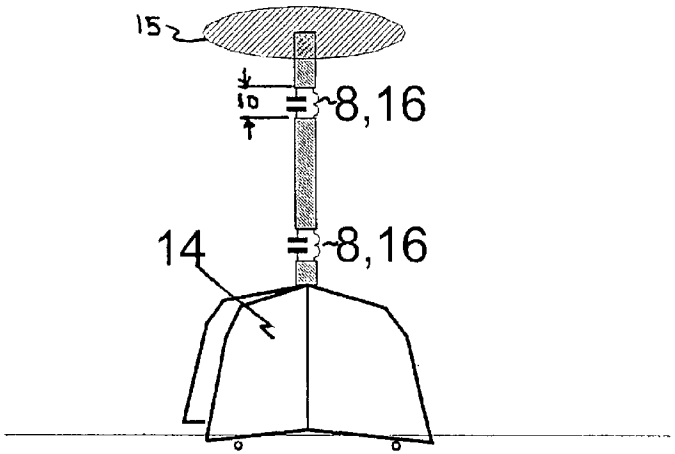
FIG. 8*d* shows a combination antenna arrangement according to the invention, similar to FIG. 8*c*, but having a roof capacitor.
Figure 8C:
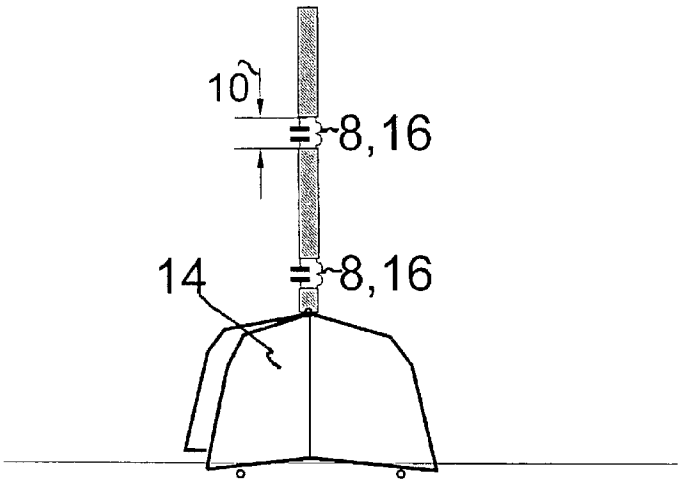
FIG. 8*c* shows a combination antenna arrangement according to the invention with an SDARS antenna having rotational symmetry, and a combined linear monopole 15 along the line of symmetry and two interruption points.

In another advantageous embodiment of the invention, the combination antenna arrangement is configured as a first antenna 14 for satellite radio reception according to the SDARS standard, as the first wireless communication service 1, and for additional antennas 15 according to the AMPS and PCS standard as additional wireless communication services 2*a* and 2*b*. In this connection, first antenna 14 according to the SDARS standard is configured with rotational symmetry, as an antenna on an essentially horizontal conductive surface, with reference to its vertical centerline. As described in U.S. Pat. No. 6,653,982 B2, a vertical combined monopole for the AMPS standard and the PCS standard is introduced into its centerline. This is switched with a suitable reactance circuit 8 at suitably selected interruption points 10, as in FIG. 8*c* or 8*d*. In FIG. 8*a*, FIG. 8*b*, as well as FIG. 8*d*, the monopole is loaded or burdened with a roof capacitor, which is provided with radial interruption points 10 shown in FIG. 8*a*, for small diameters of the circular roof plate, to avoid distortions of the directional diagram for the SDARS service. In FIG. 8*b*, additional circular interruption points 10 with reactance circuits 8 are inserted in antenna 15.

Figure 9:
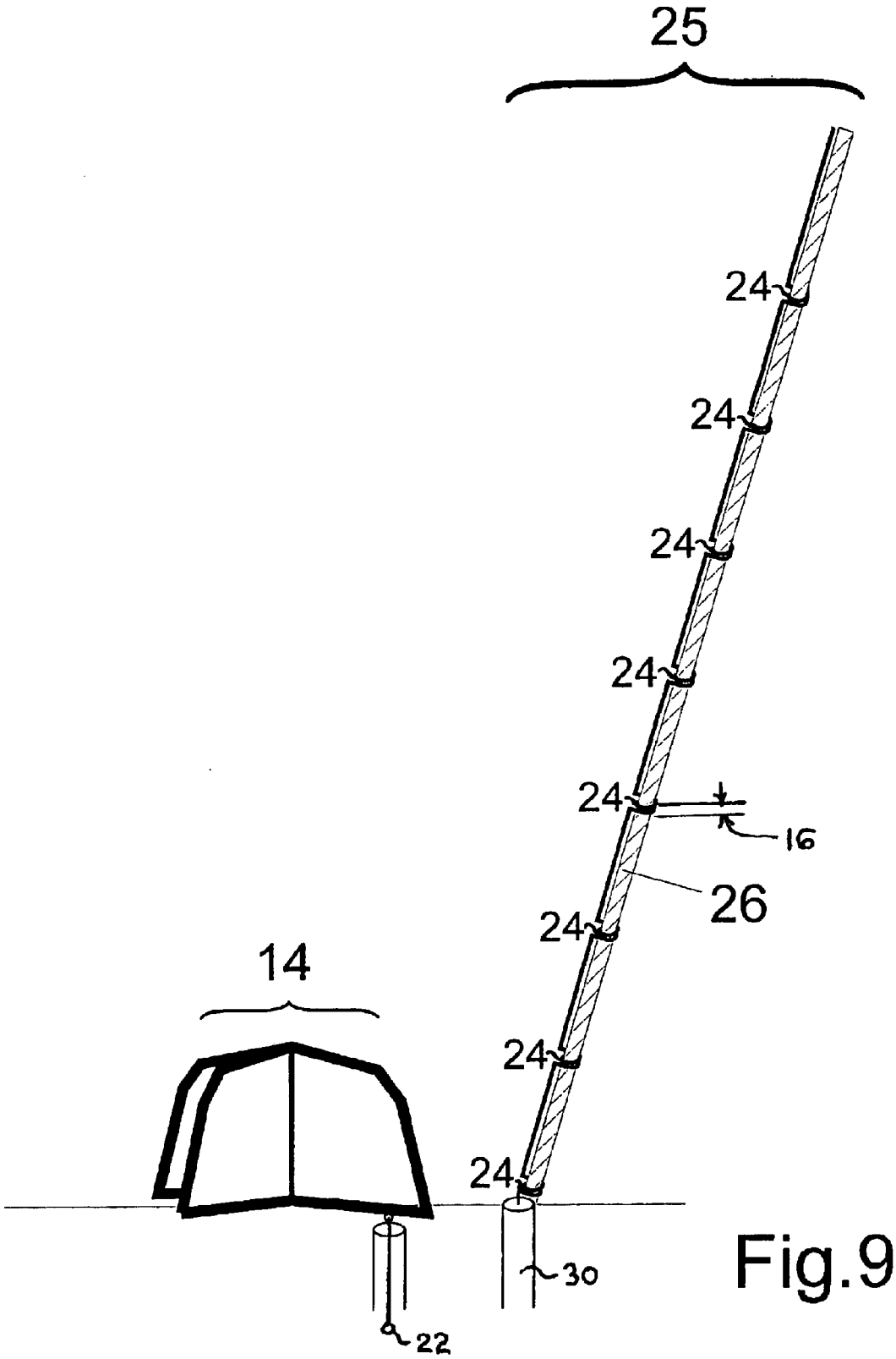
FIG. 9 shows a combination antenna arrangement according to the invention with an additional rod-shaped antenna for AM/FM reception.

FIG. 9 shows another advantageous use of the invention wherein an AM/FM antenna affixed on a rod-shaped plastic or flexible support, and configured in the close proximity of first antenna 14 for the first wireless communication service 1, e.g. an SDARS antenna. The length of this an antenna is generally selected to be between 0.4 m and 0.9 m. Applying the invention, the AM/FM monopole antenna is formed by an essentially wire-shaped conductor 25. In order to produce the high impedance state of the antenna for the frequency range 6 of the first wireless communication service 1, it is advantageous if it is provided with a series of coils 24 at the necessary intervals. These can be formed from the same wire, by means of close winding, or by means of a meander structure, so that the winding capacitor that results from this forms a parallel resonance circuit 16 with the coil. In another possible embodiment, the wire is structured as a wire coil essentially continuously wound over the length of the rod-shaped plastic support 26, which forms a sufficiently high impedance structure for the frequency range 6 of the first wireless communication service.

Accordingly, while several embodiments of the present invention have been shown and described, it is obvious that many changes and modifications may be made thereunto without departing from the spirit and scope of the invention.

What is claimed is:

1. A combination antenna arrangement for the reception of at least two wireless communication services comprising;

a first antenna (14) designed to have a closely tolerated directional diagram for an assigned frequency range (6) for the reception of a first wireless communication service, and having at least one radiation part (20) coupled to an antenna connection point (22);

at least a second antenna (15) having a plurality of spaced-apart conductor parts (3) for reception of an additional wireless communication services (2) with an assigned frequency range (9), and radiation-coupled with said at least one radiation part (20) of said first antenna (14), said conductor parts (3) of said second antenna (15) being divided into segments (4) defining interruption points (10) therebetween, the greatest dimension (5) for each segment (4) being selected to be smaller than ⅜ of the wavelength λ for the frequency range (6) of the first wireless communication service (1); and, a plurality of low loss frequency-dependent reactance circuits (8) bridging said interruption points (10) in order for the combination antenna arrangement to function, said circuits (8) having a sufficiently high impedance (7) in the frequency range (6) of the first wireless communication service (1), and an impedance (7) that is preselected for proper functioning in the frequency range (9) of the additional wireless communication services (2).

2. The combination antenna arrangement according to claim 1 wherein the dimensions (5) of said segments (4) are selected to be sufficiently small so that the closely predetermined tolerances of the directional diagram for the first wireless communication service (1) are not exceeded.

3. The combination antenna arrangement according to claim 1 comprising a further reactance circuit (8') located outside of the radiation field of the antenna, coupled to one of said antenna segments (4) so that a sufficiently high impedance (7) is present for the frequency range (6) of the first wireless communication service (1) at the point of the segment (4) to be connected, and a sufficiently low-ohm impedance (7) is present for the frequency ranges (9) of said additional wireless communication services (2).

4. The combination antenna arrangement according to claim 3 wherein said segments (4) are linear parts of the combination antenna arrangement, the width (11) of the interruption points (10) being selected to be small in comparison with the length (5) of the each of said segments (4), and said reactance circuits (8) being designed so that their impedance (7) have the frequency response of a parallel resonance circuit (16) in the frequency range (6) of the first wireless communication service (1).

5. The combination antenna arrangement according to claim 4, for a first wireless communication service (1) in the frequency range (6) and having an average frequency $f_1$ and an additional wireless communication service (2) having the frequency range (9) and the average frequency $f_2$, wherein said reactance circuits (8) comprise;

three dummy elements, so that the reactance of said reactance circuits (8) has a pole in the frequency range (6) of the first wireless communication service (1), and a zero position in the frequency range (9) of the additional wireless communication service (2), and wherein said reactance is sufficiently large in the frequency range (6) of the first wireless communication service (1), and sufficiently small in the frequency range (9) of the additional wireless communication service (2).

6. The combination antenna arrangement according to claim 4, for a first wireless communication service (1) in the frequency range (6) and having the average frequency $f_1$, and a first additional wireless communication service (2*a*) and a second additional wireless communication service (2*b*) having a first additional and a second additional frequency range (9*a*, 9*b*) and the average frequencies $f_{2a'}$, $f_{2b'}$, whereby $f_{2a}<f_1<f_{2b}$, wherein said reactance circuits (8) comprise four dummy elements arranged so that the reactance of the reactance circuit (8) had a pole in the frequency range (6) of the first wireless communication service (1), and a zero position, in each instance, in the frequency ranges (9*a*, 9*b*) of the additional wireless communication services (2*a*, 2*b*), and that the reactance is sufficiently large, in the frequency range (6) of the first wireless communication service (1), and sufficiently small in the frequency ranges (9*a*, 9*b*) of the additional wireless communication service (2*a*, 2*b*).

7. The combination antenna arrangement according to claim 4, for a first wireless communication service (1) in the frequency range (6) and having the average frequency $f_1$, and a first additional wireless communication service and a second additional wireless communication service (2*a*, 2*b*) having the first frequency range (9*a*) of the additional wireless communication service (2*a*) and the second frequency range (9*b*) of the second additional communication service (2*b*) and the average frequencies $f_{2a'}$ and $f_{2b'}$ whereby $f_{2a}$ and $f_{2b}$ are both greater than, or both smaller than $f_1$, wherein said reactance circuit (8) comprises five dummy elements, so that the reactance of said reactance circuit (8) has a pole in the frequency range (6) of the first wireless communication service (1), and a zero position, in each instance, in the frequency ranges (9*a*, 9*b*) of the additional wireless communication services (2*a*, 2*b*), and that a pole position is formed between the first and the second frequency range (9*a*, 9*b*) of the first additional and the second additional wireless communication service (2*a*, 2*b*), the frequency and said dummy elements being selected so that the reactance is sufficiently large, in the frequency range (6) of the first wireless communication service (1), and sufficiently small in the frequency ranges (9*a*, 9*b*) of the additional wireless communication service (2*a*, 2*b*).

8. The combination antenna arrangement according to claim 3, wherein said segments (4) are flat parts of the combination antenna arrangement, the width (11) of the interruption points (10) being selected to be small in comparison with the dimension (5) of said segments (4), and said low loss reactance circuits (8) are designed so that the impedance (7) active between said interruption points (10), has the frequency response of a parallel resonance circuit (16) in the frequency range (6) of the first wireless communication service (1).

9. The combination antenna arrangement according to claim 1 wherein said first antenna (14) receives satellite radio reception according to the SDARS standard as the first wireless communication service (1) and said at least one second antenna (15) receives the AMPS and PCS standard as additional wireless communication services (2*a*, 2*b*), wherein said first antenna (14) receiving the SDARS standard is configured as an antenna on an essentially horizontal conductive surface, having rotational symmetry with reference to its vertical center line, and having a vertical combined monopole configured in its center line, for the AMPS standard as a first additional wireless communication service (2*a*) and the PCS standard as a second additional wireless communication service (2*b*), and said reactance circuits (8) are inserted into said interruption points (10) in said monopole.

10. The combination antenna arrangement according to claim 9 wherein said monopole is formed with a roof capacitor, and said interruption point (10) having a reactance circuit (8) for selective separation of the monopole in the SDARS frequency range is present in the vicinity of the top end of the monopole.

11. The combination antenna arrangement according to claim 10 wherein said roof capacitor is essentially configured with rotational symmetry relative to the monopole, and that interruption points (10) comprise radially guided slits, the slit width of which is selected to be sufficiently large so that the impedance (7) thereby resulting from the edges of the slits is sufficiently large for the SDARS frequency.

12. The combination antenna arrangement according to claim 1 wherein said second antenna (15) comprises a AM/FM monopole antenna consisting of a continuous wire conductor (25) disposed over the length of a rod shaped flexible support with a length necessary for AM/FM reception, and disposed in close proximity of said first antenna (14) for the first wireless communication service (1), said conductor (25) being formed into spiral-shaped or meander-shaped coils (24) disposed at the necessary distances from one another, wherein said coils (24) are configured so that suitable parallel resonance circuits (16) result from their inductance together with their inherent capacitance, said conductor (25) being configured so that the antenna has sufficiently high impedance for the frequency range (6) of the first wireless communication service (1).

13. A combination antenna arrangement for a first wireless communication service (1) having a frequency bandwidth (13) and several additional wireless communication services (2) comprising;

a separate first antenna (14) designed to have a closely tolerated directional diagram for the first wireless communication service (1) having the frequency bandwidth (13);

one or more additional linear antennas (15) having a monopole design having spaced apart segments (3) with interruption points (10) therebetween, for additional wireless communication services (2); and reactance circuits (8) designed as parallel resonance circuits (16), the resonance frequency of which is tuned approximately to the average frequency of the frequency range (6) of the first wireless communication service (1), and having dummy elements selected so that the impedance (7) in effect between said interruption points (10) is sufficiently great, in each instance, over the frequency bandwidth (13), so that the closely predetermined tolerances of the directional diagram are not exceeded.

14. The combination antenna arrangement according to claim 13 wherein said first antenna (14) is used for satellite radio reception according to the SDARS standard as the first wireless communication service (1), and said additional antennas (15) are used for reception according to the AMPS and PCS standard as a first additional wireless communication service and a second additional wireless communication service (2*a*, 2*b*), wherein said additional antennas (15) for the first additional and the second additional wireless communication service (2*a*, 2*b*) comprises a combined antenna having the design of a vertical monopole, supplied at the bottom and, having a roof capacitor, over a conductive surface, and having two interruption points (10) of which the first is formed in the vicinity of the bottom end of the monopole and the second is formed at about ⅔ of the height of the monopole, and said reactance circuits (8) are constructed as a parallel resonance frequency at about the average frequency $f_1$ of the frequency range (6) of the first wireless communication service (1), and the inductance of the parallel resonance circuit (16) at the bottom interruption point (10) for the frequency range of the first additional wireless communication service (2*a*) in the AMPS frequency range is selected to be sufficiently small, and the inductance of the parallel resonance circuit at the top interruption point (10) for the frequency range of the second additional wireless communication service (2*a*) in the PCS frequency range is selected to be larger so that the top part of the antenna is active in the lower AMPS frequency range, but is essentially inactive in the PCS range having a higher frequency.

15. A combination antenna arrangement for a first wireless communication service (1) having a frequency bandwidth (13) and several additional wireless communication services comprising;

a separate first antenna (14) designed to have a closely tolerated directional diagram for receiving the first wireless communication service (1) having the frequency bandwidth (13);

a second antenna (15) disposed adjacent to said first antenna (14) and composed of flat conductors arranged in spaced apart segments for receiving additional wireless communication services (2); and a plurality of reactance circuits (8) coupled between said antenna segments as parallel resonance circuits (16), the resonance frequency of which is tuned approximately to the average frequency of the frequency range (6) of the first wireless communication service (1), and having dummy elements selected so that their impedance (7), with respect to the capacitance between the edges of said antenna segments is sufficiently large, in each instance, over the frequency bandwidth (13), so that the closely predetermined tolerances of the directional diagram are not exceeded.

16. The combination antenna arrangement according to claim 15 wherein said first antenna (14) is used for satellite radio reception according to the SDARS standard as the first wireless communication service (1), and said second antenna (15) is used for reception according to the AMPS and PCS standard as a first additional wireless communication service and a second additional wireless communication service (2*a*, 2*b*), wherein said second antenna (15) for the first additional and the second additional wireless communication service (2*a*, 2*b*) comprises a combined antenna having the design of a vertical monopole, supplied at the bottom and, having a roof capacitor, over a conductive surface, and having two interruption points (10) of which the first is formed in the vicinity of the bottom end of the monopole and the second is formed at about ⅔ of the height of the monopole, and said reactance circuits (8) are constructed as a parallel resonance frequency at about the average frequency $f_1$ of the frequency range (6) of the first wireless communication service (1), and the inductance of the parallel resonance circuit (16) at the bottom interruption point (10) for the frequency range of the first additional wireless communication service (2*a*) in the AMPS frequency range is selected to be sufficiently small, and the inductance of the parallel resonance circuit at the top interruption point (10) for the frequency range of the second additional wireless communication service (2*a*) in the PCS frequency range is selected to be larger so that the top part of the antenna is active in the lower AMPS frequency range, but is essentially inactive in the PCS range having a higher frequency.

* * * * *